United States Patent [19]

Staats et al.

[11] Patent Number: 4,695,693

[45] Date of Patent: Sep. 22, 1987

[54] TRIANGULAR ANTENNA ARRAY FOR MICROWAVE OVEN

[75] Inventors: James E. Staats; Louis H. Fitzmayer, both of Louisville, Ky.

[73] Assignee: General Electric Company, Louisville, Ky.

[21] Appl. No.: 915,048

[22] Filed: Oct. 2, 1986

[51] Int. Cl.[4] ..... H05B 6/72

[52] U.S. Cl. ..... 219/10.55 F

[58] Field of Search ..... 219/10.55 F, 10.55 E, 219/10.55 A, 10.55 R

[56] References Cited

U.S. PATENT DOCUMENTS

| | | | |
|---|---|---|---|
| 2,704,802 | 3/1955 | Blass et al. | 219/10.55 |
| 3,680,136 | 7/1972 | Collings | 343/746 |
| 3,810,248 | 5/1974 | Risman et al. | 219/10.55 |
| 4,019,009 | 4/1977 | Kusunoki et al. | 219/10.55 F |
| 4,399,341 | 8/1983 | Yasuoka | 219/10.55 R |
| 4,446,349 | 5/1984 | Smith | 219/10.55 F |
| 4,458,126 | 7/1984 | Dills et al. | 219/10.55 F |

*Primary Examiner*—Philip H. Leung

*Attorney, Agent, or Firm*—H. Neil Houser; Radford M. Reams

[57] ABSTRACT

An excitation system structurally compatible with a low profile streamlined microwave oven appliance configuration, comprising a generally planar antenna member disposed between the bottom wall and a support shelf centered laterally in the oven cavity and extending over a substantial portion of the bottom wall. An open peripheral region is defined between the front, back, side and bottom oven cavity walls and the peripheral edge of the antenna member. A plurality of radiating apertures are formed in the antenna member and arranged in a triangular fashion such that straight lines connecting the centers of any three closely adjacent apertures intersect to define an equilateral triangle. Microwave energy is coupled from the magnetron to the center point of the antenna member, whereby microwave energy radiates from the apertures in the antenna member to heat items placed on a support shelf from below and energy propagates between the antenna member and the bottom cavity wall to the periphery of the antenna member from which it is radiated through the peripheral region into the interior of the cavity and reflected by the front, back, side and top cavity walls to the heat items on support shelf from above.

4 Claims, 7 Drawing Figures

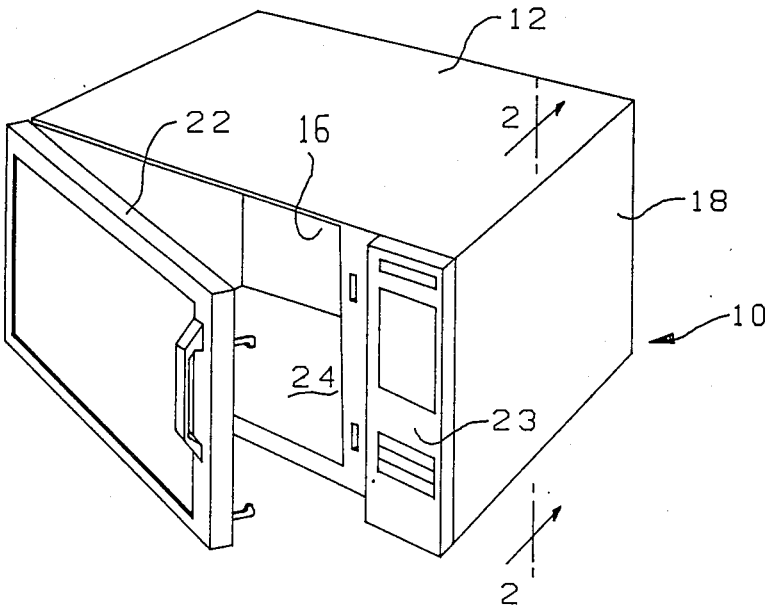
FIG. 1
FIG. 6
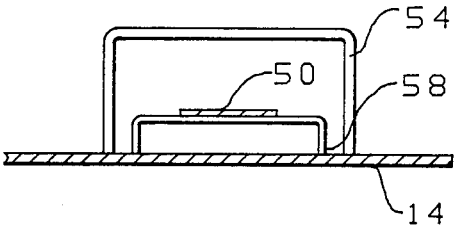
FIG. 7
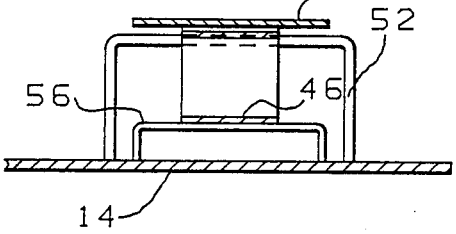
FIG. 4
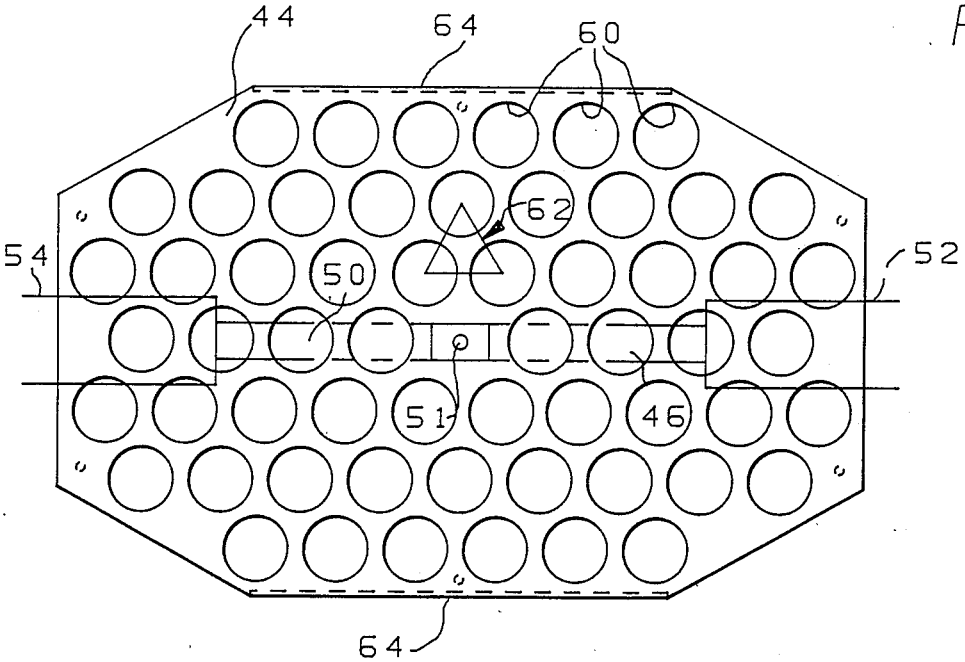
FIG. 5
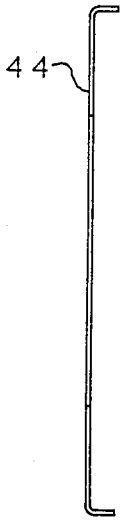

TRIANGULAR ANTENNA ARRAY FOR MICROWAVE OVEN

BACKGROUND OF THE INVENTION

The present invention relates to a microwave cooking oven and more specifically to an improved excitation system for such an oven.

Non- uniform energy distribution in the cooking cavity is a continuing problem in the design of microwave cooking ovens symptomized by hot and cold spots in the cavity. A number of different approaches to enhance uniform energy distribution by altering standing wave patterns in the cavity have been tried. One approach involves use of a so-called "mode stirrer" which typically resembles a fan with metal blades. Typically, the stirrer is located near the point where energy is coupled into the cavity. The idea is to randomize energy reflections in the cavity by introducing time varying scattering of the energy by reflection of the stirrer blades as the energy enters the cavity. Another approach involves the use of a rotating antenna in the cavity. Typically, both the mode stirrer and the rotating antenna approaches involve structures intruding into the cooking space, reducing the usable space in the cavity.

Use of stationary radiating slots beneath the food load to be heated is also known in the art. See for example U.S. Pat. Nos. 4,019,009 to Kusunoki et al; 2,704,802 to Blass et al; 3,810,248 to Risman et al. In each of these examples a waveguide structure is provided in the bottom of the cavity to couple energy from the magnetron to the slots. Such an arrangement tends to localize the energy distribution in the cavity to the vicinity of the slots and also involves a waveguide structure protruding from the bottom of the oven, again reducing the available space in the cavity. Since the slots are near field radiators, food loads are heated primarily from the bottom with hot spots in the vicinity of the specific slots. In commonly assigned U.S. Pat. No. 4,458,126 to Dills et al, a rotating upper antenna is combined with lower stationary slots such that the antenna pattern fills in the cold spots of the slots to provide uniform energy distribution at the cooking plane. This arrangement works very well in a full-size countertop microwave oven cavity, but involves substantial protrusion into the oven from both the top and bottom.

In view of the desire to minimize the counter space occupied by a microwave oven, there is a need for an excitation system which will provide enhanced time averaged uniformity of energy distribution in the cavity with minimum protrusion into the cooking cavity and also lending itself to a relatively low profile streamlined external oven cabinet configuration.

It is therefore an object of the present invention to provide a relatively simple efficient excitation system for a microwave oven which provides good time averaged uniformity of energy distribution in the cavity requiring no upper protrusion into the cavity and minimal space between the top and bottom walls of the cavity and the outer cabinet to provide a minimum overall height for the oven appliance.

SUMMARY OF THE INVENTION

In accordance with the present invention a microwave oven having a cooking cavity for receiving objects to be heated comprising a generally rectangular enclosure defined by top, bottom, back and pair of opposing side walls and a front wall defined by a front opening access door is provided with an excitation system structurally compatible with a low profile streamlined microwave oven appliance configuration. A microwave pervious support shelf is disposed within the cavity spaced above and extending generally parallel to the bottom wall of the cavity. A generally planar antenna member is disposed between the bottom wall and the support shelf closely adjacent the support shelf. The antenna member is centered laterally in the cavity and extends over a substantial portion of the bottom wall with an open peripheral region being defined between the front, back, side and bottom walls and the peripheral edge of the antenna member. A plurality of radiating apertures are formed in the antenna member and arranged in a triangular fashion such that straight lines connecting the centers of any three closely adjacent apertures intersect to define an equilateral triangle. Microwave energy is coupled from the magnetron to the center point of the antenna member. By this arrangement, microwave energy radiates from the apertures in the antenna member to heat items placed on a support shelf from below and energy propagates between the antenna member and the bottom wall to the periphery of the antenna member from which it is radiated through the peripheral region into the interior of the cavity and reflected by the front, back, side and top walls to the heat items on support shelf from above.

In accordance with another aspect of the present invention, the radiating apertures are of circular configuration and of a diameter chosen sufficiently near cutoff that apertures directly beneath a dielectric utensil or food item placed on the shelf wall will radiate substantially more than apertures not covered by the utensil or food load.

In a preferred form of the invention a strip line member is employed to couple energy from the magnetron to the center of the antenna member. The strip line member comprises a first section extending from the magnetron launch area to the center of the antenna and a second section extending from the center of the antenna toward the opposing side wall. The length and termination of the second section of the microwave strip line is selected to provide proper phasing to establish a maximum current point at the center point of the antenna member. A first shield housing is provided extending from one side wall enclosing a portion of the first strip line section which extends from the magnetron to the center of the antenna, and a second shielding housing is provided extending from the opposing side wall enclosing the terminal portion of the second strip line section which extends from the center of the antenna toward the opposing side wall. The first housing prevents energy leakage from the first strip line section from overheating items on the support shelf near the one side wall and the second housing provides proper symmetry for the strip line.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings in which:

FIG. 1 is a perspective view of a microwave oven illustratively embodying the excitation system of the invention;

FIG. 4 is a top view of an embodiment of the antenna member of the present invention removed from the oven;

FIG. 5 is a side view of the antenna member of FIG. 4;

FIG. 6 is a partial sectional view of the oven of FIG. 2 taken along lines 6—6; and FIG. 7 is a partial sectional view of the oven of FIG. 2 taken along lines 7—7.

DETAILED DESCRIPTION

Figure 2:
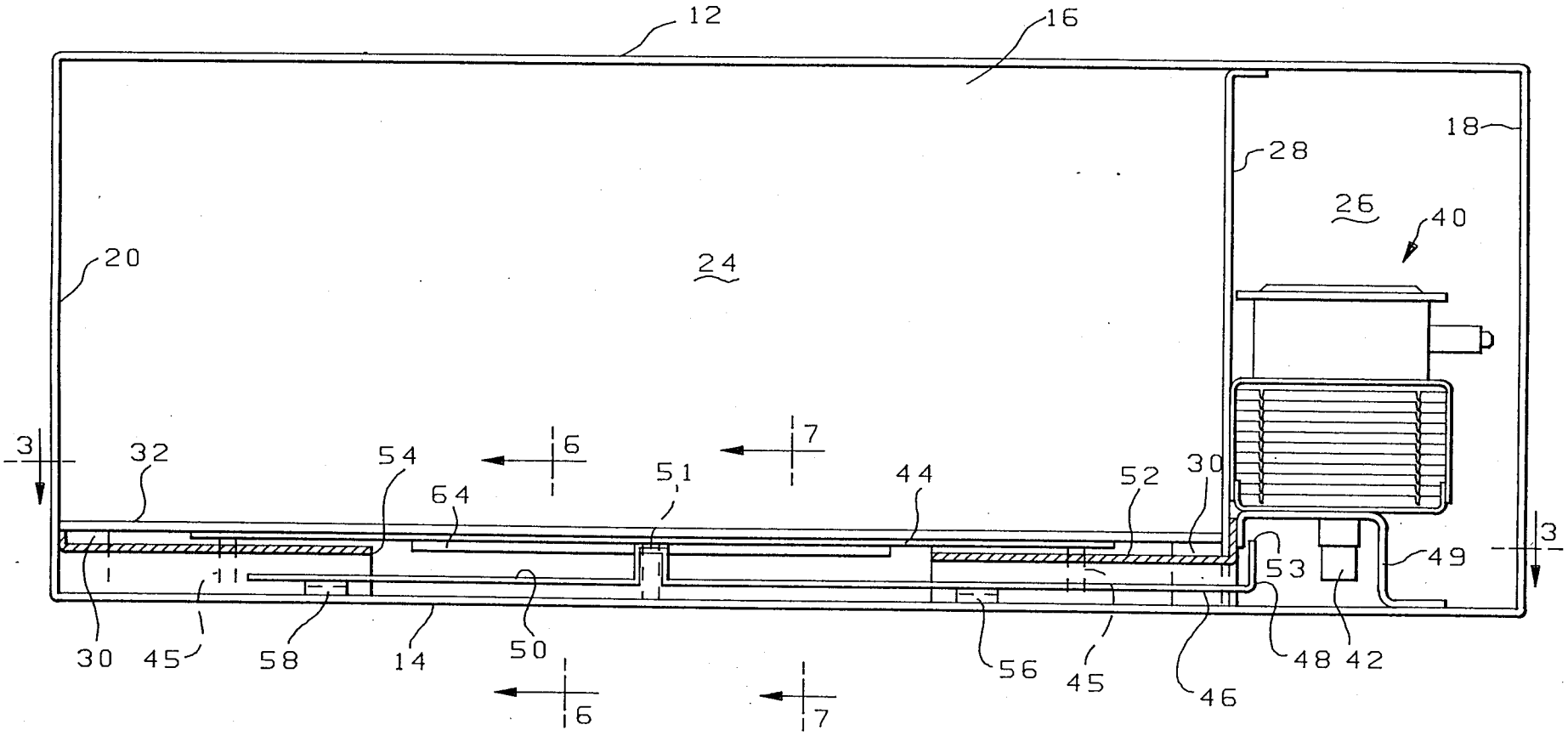
FIG. 2 is a front schematic sectional view of the microwave oven of FIG. 1 taken along lines 2—2.
Figure 3:
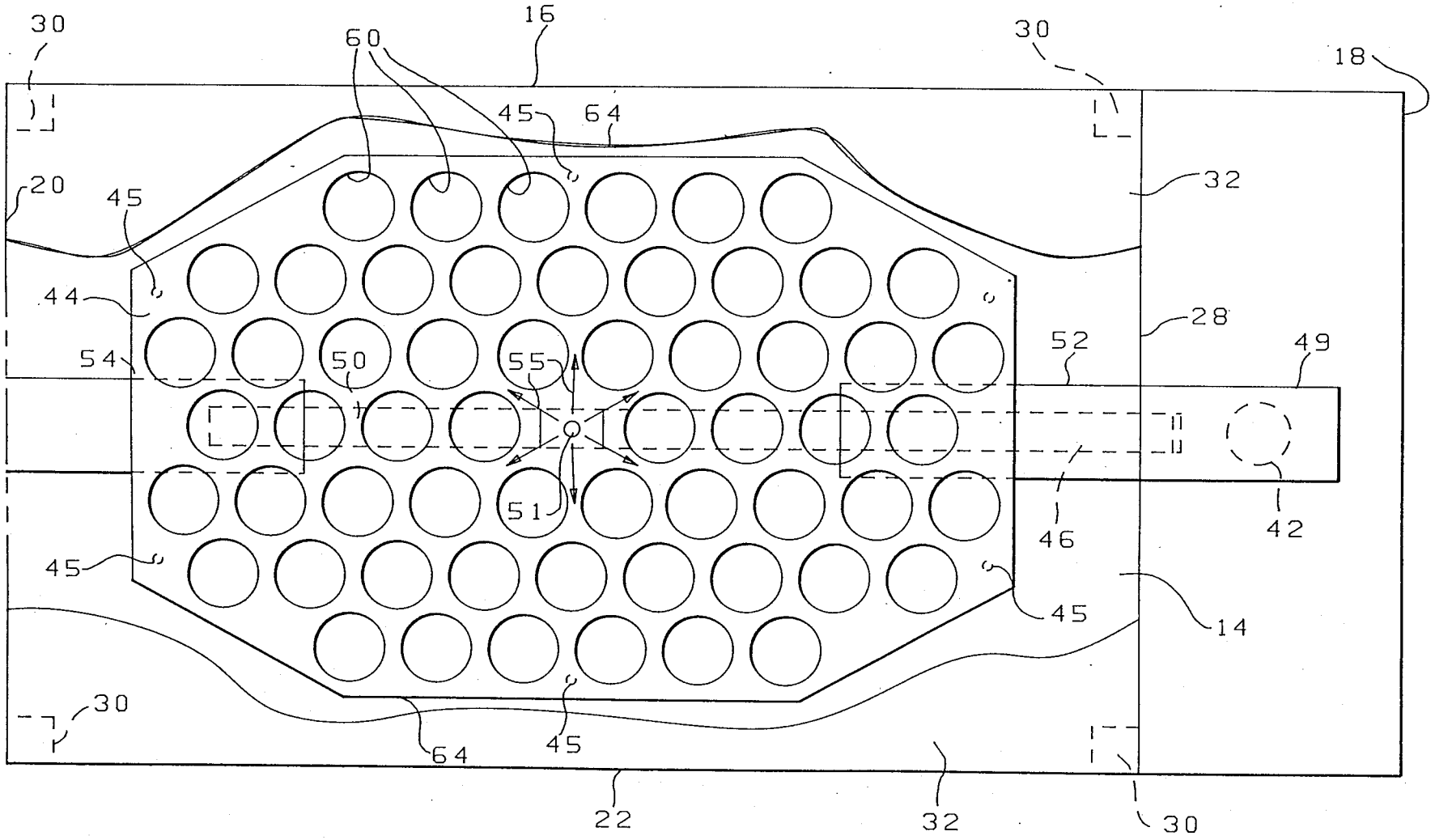
FIG. 3 is a highly schematic partial sectional top view of the oven of FIG. 1 taken along lines 3—3 to illustrate the antenna member in position in the bottom of the cooking cavity.

Referring now to FIGS. 1–7, there is shown a microwave oven designated generally 10. The oven cabinet comprises six cabinet walls including upper and lower walls 12 and 14 and rear wall 16, two side walls 18 and 20 and a front wall partly formed by hingedly supported door 22 and partly by control panel 23. The space inside the cabinet is divided by cavity side wall 28 generally into a cooking cavity 24 and a controls compartment 26. Nominal dimensions of cavity 24 are 8 ¼inches high by 18 inches wide by 11 inches deep. In each corner of the cavity extending upwardly from the bottom wall 14 are provided support shoulders 30 which support shelf 32 approximately ¾ inches above bottom wall 14. Shelf 32 is made of a microwave pervious dielectric material such as that available commercially under the trademark "Pyroceram" or "Neoceram" and is disposed in the cavity 24 approximate to and substantially parallel to bottom wall 14 to support loads being heated in cavity 24.

Controls compartment 26 has a magnetron 40 which is adapted to provide microwave energy having a center frequency of approximately 2450 MHz at output probe 42 thereof when coupled to a suitable source of power (not shown) such as the 120 volt AC power supply typically provided at domestic wall receptacles.

The front facing opening of controls compartment 26 is enclosed by control panel 23. It will be understood that numerous other components are required in a complete microwave oven but for clarity of illustration and description only those elements believed essential for a proper understanding of the present invention are shown and described. Such other elements may all be conventional and as such are well known to those skilled in the art.

The structure of the excitation system in accordance with the present invention as illustratively embodied in microwave oven 10 will now be described. A generally planar antenna member 44 is disposed between bottom wall 14 and support shelf 32 closely adjacent the bottom face of support shelf 32. Antenna member 44 is centered laterally in cavity 24 and extends over a substantial portion of bottom wall 14. Antenna member is supported from the bottom cavity wall by dielectric spacers 45, which serve to maintain the alignment and spacing of the antenna member relative to the ground plane provided by the bottom wall.

Microwave energy from magnetron output probe 42 of magnetron 40 is coupled to antenna member 44 via a partially shielded microwave strip line member comprising a first strip line section 46 extending from microwave launch area 48 enclosing magnetron probe 42 to the mid-point 51 of antenna member 44 and a second section 50 extending from the mid-point 51 of antenna member 44 toward cavity side wall 20. Microwave energy launching area 48 for energy radiating from magnetron probe 42 is provided by housing 49 which encloses probe 42 on top and sides. Launch area 48 is enclosed on the bottom by the extension of bottom cavity wall 14 and the launch area opens into a first shield housing 52. The upwardly extending end portion of strip line member 53 is positioned in the launch area 48 to couple energy radiated from probe 42.

First shield housing 52 formed by an open ended inverted U-shaped metallic channel member extends approximately half way from side wall 28 to the center of the antenna member and encloses a portion of the first strip line section 46. The purpose of shield housing 52 is to limit energy leakage from the strip line section 46 so that most of the microwave energy propagates along the strip line to the center of antenna 44. Housing 52 also prevents uneven heating of the foods in the vicinity of the housing. The second strip line section 50 and its similarly formed shield housing 54 is provided for structural symmetry to assure the proper phasing of the excitation of the antenna member. Strip line sections 46 and 50 are fastened in good electrical current to each other and to antenna 44 at center point 51 thereof by suitable means such as pop rivet. It will be appreciated that the shield housings could each extend from the side walls to the center of the cavity. However, it has been found that by extending each housing only part of the way as in the illustrative embodiment, the shielding is sufficient to provide the desired efficiencies of excitation of antenna member 44 while facilitating assembly of strip line sections 46 and 50 and mounting of antenna member 44.

The contact point at 51 of the strip line member and the antenna member is a low impedance point due to its being the intersection for six parallel circuits or current paths emanating from the center of the antenna member radially outwardly. The direction of these current paths being designated by arrows 55 in FIG. 3. The length of each section of the strip line is selected for proper impedance matching. In the preferred embodiment, the horizontal length of the first strip line section 46 is approximately 8.8 inches and the horizontal length of the second section 50 is approximately 6 inches. These dimensions have been found to provide satisfactory impedance matching for the oven cavity of the illustrative embodiment.

As best seen in FIGS. 2, 6 and 7, strip line sections 46 and 50 are supported from the bottom wall of the cavity by insulated support meabers 56 and 58 respectively. The distance or the height between bottom cavity wall 14 and the strip line section affects the rate of attenuation of power with distance along the length of the strip line section. This height is empirically adjusted to provide the attenuation necessary to achieve the desired power distribution along the strip line sections when combining power reflected from the remote end of the second strip line section 50 with unreflected power propagating down the strip line sections.

Since the microwave feed structure is only at the bottom of the cavity, top and side heating of the load is achieved by the reflection from the cavity walls of energy radiating from the periphery of the antenna member 44. To avoid the blocking affect of the food load supported on shelf 32 above antenna 44, the antenna must have a larger lateral extent than the food loads typically supported from the support shelf. Also, in order to avoid uneven bottom heating of the load the antenna member must provide a radiating pattern which is uniform across the bottom of the load and have power left over at the periphery of the antenna for radiation into the upper regions of the cavity.

Both of these requirements, the spreading of energy out over a relatively large expanse of the bottom of the oven with the desired uniformity, and delivering energy to the antenna periphery for radiation therefrom are met in accordance with the present invention by providing radiating member 44 with a plurality of radiating apertures 60, spaced in triangular fashion such that straight lines connecting the centers of any three closely adjacent apertures intersect to define an equilateral triangle as illustrated at 62 (FIG. 4). This spacing of the apertures is critical in providing the desired uniformity of radiation across the surface of the antenna. By arranging the apertures in this fashion, the radial distance between any two adjacent apertures is the same, and the radiation from adjacent apertures is of the proper phase to avoid cancellation due to destructive interference.

To radiate, the circumference of the aperture must be greater than the cut-off value of one-half the free space wave length. In a preferred form of the invention the apertures are circular having a diameter selected sufficiently close to cut off that each aperture radiates substantially more energy when covered by the load to be heated than when uncovered. The placement of a dielectric pan or load over an aperture increases the cut-off wave length for the covered aperture relative to its free space cut-off wave length. Thus, that particular aperture is effectively not as close to cut off as an uncovered aperture and hence tends to radiate substantially more power than the uncovered aperture. The dielectric support shelf sets a lower limit on the dielectric loading of the apertures and a dielectric vessel containing water sets the other extreme when empirically establishing the desired aperture sizes.

The minimum distance between apertures is somewhat constrained by the need for sufficient structural integrity and electrical conduction. This parameter also has a bearing on aperture size. The spacing between the apertures is chosen to be not less than $\frac{1}{4}$ inch such that the width of the metal is a minimum of $\frac{1}{4}$ inch throughout the plane of the antenna member. Antenna member 44 is flanged at sides 64 also to enhance the structural integrity of the generally planar member. In the illustrative embodiment an aperture diameter of approximately $1\frac{1}{8}$inches has been found to provide satisfactory performance while satisfying the $\frac{1}{4}$ inch minimum spacing requirement.

While specific dimensions are provided for the illustrative embodiment herein described, these dimensions do not necessarily represent limits of useful values or limitations on the full scope of the invention, but rather are intended to provide direction to those skilled in the art. Furthermore, while the specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A microwave cooking appliance comprising:

a cooking cavity for receiving objects to be heated, defined by a top wall, a bottom wall, a back wall, a pair of opposing side walls and a front wall defined by a front opening access door;

a microwave pervious support shelf disposed within said cavity spaced above and extending generally parallel to said bottom wall;

a source of microwave energy;

a generally planar antenna member disposed between said bottom wall and said support shelf, said antenna member being centered laterally in said cavity and extending over a substantial portion of said bottom wall, said antenna member having a peripheral edge spaced apart from said front, back and side walls thereby defining a peripheral region between said front, back, side and bottom walls and said peripheral edge of said antenna member; said member having formed therein a plurality of radiating circular apertures arranged in triangular fashion such that straight lines connecting the centers of any three closely adjacent apertures intersect to define an equilateral triangle;

means for coupling microwave energy from said microwave energy source to the center point of said antenna member comprising a microwave strip line member extending from said source beneath said antenna member and electrically connected to the center point of said antenna member;

whereby microwave energy radiates from said apertures to heat items placed on said support shelf from below and energy is radiated through said peripheral region into the interior of said cavity and reflected by said front, back and top walls to heat the items on said shelf from above.

2. The microwave cooking appliance of claim 1 wherein said microwave strip line comprises a first section which extends between said center of said antenna member and one of said side walls projecting through said one side wall for coupling to said microwave energy source and a second section which extends from said center toward the side wall opposite said one side wall;

said appliance further comprising a first shielding housing extending from said one side wall enclosing a portion of said first strip line section and a second shielding housing extending from said other side wall enclosing the terminal portion of said second strip line section, the length and termination of said second section of said microwave strip line being selected to provide proper phasing to establish a maximum current point at said center point of said antenna member, whereby said first housing prevents energy leakage from said first strip line section from overheating items on said support shelf near said one side wall and said second strip line section and second housing provides proper symmetry for said strip line.

3. A microwave cooking appliance comprising:

a cooking cavity for receiving objects to be heated, defined by a top wall, a bottom wall, a back wall, a pair of opposing side walls and a front wall defined by a front opening access door;

a microwave pervious support shelf disposed within said cavity spaced above and extending generally parallel to said bottom wall;

a source of microwave energy;

a generally planar antenna member disposed between said bottom wall and said support shelf, said antenna member being centered laterally in said cavity and extending over a substantial portion of said bottom wall, said antenna member having a peripheral edge spaced apart from said front, back and side walls thereby defining a peripheral region being defined between said front, back, side and bottom walls and said peripheral edge of said antenna member; said member having formed therein a plurality of circular radiating apertures arranged in triangular fashion such that straight lines connecting the centers of any three adjacent apertures intersect to define an equilateral triangle, the diameter of said apertures being sufficiently near cut-off that apertures covered by a dielectric load being heated on said shelf radiate substantially more than apertures not covered by the dielectric load;

means for coupling microwave energy from said microwave energy source to said antenna member comprising a microwave strip line member extending from said source beneath said antenna member and electrically connected to the center point of said antenna member;

whereby microwave energy radiates from said apertures to heat items placed on said support shelf from below and microwave energy is radiated through said peripheral region into the interior of said cavity and reflected by said front, back and top walls to heat the items on said shelf from above.

4. The microwave cooking appliance of claim 3 wherein said microwave strip line comprises a first section which extends between said center of said antenna member and one of said side walls projecting through said one side wall for coupling to said microwave energy source and a second section which extends from said center toward the side wall opposite said one side wall;

said appliance further comprising a first shielding housing extending from said one side wall enclosing a portion of said first strip line section and a second shielding housing extending from said other side wall enclosing a portion of said second strip line section whereby said first housing prevents overheating of items on said support shelf near said one side wall and said second strip line section and associated housing provides proper symmetry and phasing for said strip line.

* * * * *